United States Patent [19]

Arikawa et al.

[11] 4,057,774

[45] Nov. 8, 1977

[54] MINIATURE TIME-DELAY FUSE

[76] Inventors: Hiroo Arikawa, 1-14-9, Oyamadai, Setagaya, Tokyo; Fumitake Akiyama, 1332 Kamisugeta-cho, Hodogaya, Yokohama; Masaya Maruo, 1-29-14, Shinkoyasu, Kanagawa, Yokohama, all of Japan

[21] Appl. No.: 677,749

[22] Filed: Apr. 16, 1976

[30] Foreign Application Priority Data

Apr. 16, 1975 Japan ..... 50-045334

[51] Int. Cl.[2] ..... H01H 85/04

[52] U.S. Cl. ..... 337/164; 337/166

[58] Field of Search ..... 337/163, 164, 165, 166, 337/292, 297

[56] References Cited

U.S. PATENT DOCUMENTS

| | | | |
|---|---|---|---|
| 3,144,534 | 8/1964 | Baumbach | 337/165 X |
| 3,267,238 | 8/1966 | Arikawa et al. | 337/164 |
| 3,869,689 | 3/1975 | Kasamatu | 337/164 |

*Primary Examiner*—George Harris

[57] ABSTRACT

A time-delay fuse is provided comprising a glass or ceramic tube sealed at both ends with sealing means such as, e.g., ferrules. An elongated generally cylindrical core member, made from a highly heat conductive material (a sintered blend of aluminum oxide and magnesium oxide spinel), is diagonally disposed in said tube and rigidly fixed at both ends in intimate contact with said sealing means. The fuse also comprises a wire strand spirally wound on said elongated core member. The wire strand is made by winding a first metallic wire element over a second mutually fusible wire element and is soldered at both ends with a high melting solder element.

8 Claims, 4 Drawing Figures

MINIATURE TIME-DELAY FUSE

BACKGROUND OF THE INVENTION

There are a variety of types and sizes of fuses which are presently employed in different electrical and electronic circuits, and, indeed, their use in such circuits has been known for years. As it is well known, a fuse is a device intended to melt and open an electrical circuit whenever the ampere load on the circuit exceeds a predetermined safe value, i.e., the rated current capacity of the fuse. However, in some circuits such as, for example in A-C motor circuits, the fuse opens too quickly on moderate overloads. In order to overcome this difficulty, socalled time-delay (time-lag) fuses are employed which open the circuit only after an overload period of several times as long as that of an ordinary fuse.

Fuses having a fusible wire element wound over a core member made of aluminum oxide (alumina; $Al_2O_3$) and magnesium oxide (magnesia; MgO) have been used in the past. The core member of this type of fuse usually have a star-shaped or irregular cross-section and includes a means for interrupting the electric arc which is placed in the fuse. These fuses however are designed for rapid cooling of the heat generated by the electric current by utilizing the high heat conductivity and high heat diffusivity of alumina and magnesia from which the core member is made. However, these fuses are not intended to be used as time-lag fuses since they do not possess time lag charcteristics but rather, they are used whenever improved rated current capacity is needed.

Spring type fuses having time lag characteristics have also been in general use. These types of fuses which employ low melting point solder as their heat storage element have been difficult to mass produce while maintaining a fixed tensile strength on the spring and an adequate amount of low melting point solder. Additionally, they have the inherent defect of straggling in their fusing characteristics due to the heating action arising from repeated current loads during use or long term adverse effect on the spring tensile force.

Another type of time-delay fuse employs a single fusible wire element wound over a glass fiber or a glass tube. However, since glass has a low softening point (650°–700° C.), and it is necessary to use a wire having a lower melting point than the softening temperature of the glass, this limits the types of wires that can be employed in this type of fuse.

Other time-delay types of fuses are also known, but none of these prior art types of fuses have proven to be entirely satisfactory for one reason or another as will become more evident from the ensuing description of the invention.

SUMMARY OF THE INVENTION

In accordance with this invention, an improved time-delay (lag) fuse is provided which is remarkably superior to the prior art types of time-delay fuses, and which can be readily mass produced at low cost while retaining their mechanical rigidity and excellent time-delay characteristics. The time-delay fuse of this invention comprises an insulated tube (e.g., a glass or ceramic tube) provided with sealing means (e.g., ferrules) at both ends. An elongated generally cylindrical (rod-like) core member having a wire strand spirally wound thereon is diagonally disposed in said glass tube and is rigidly fixed therein in intimate contact with said sealing means. The wire strand is defined by a pair of mutually fusible wire elements consisting of a first wire element wound on a second wire core and is soldered at the ends of the elongated core member by a high melting solder element. The elongated core member is characterized by its high thermal conductivity and is conveniently made from a highly heat conductive ceramic material, preferably a sintered blend of aluminum oxide and magnesium oxide spinel.

The time-delay fuse of this invention will now be described in detail with particular reference to the accompanying drawings which are made a part of this application. Similar character references are employed in the drawings to designate like parts.

DETAILED DESCRIPTION OF INVENTION

Figure 1:
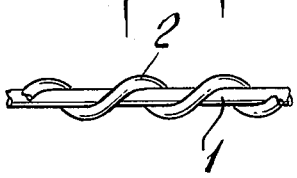
FIG. 1 is a side view of the wire strand which is used in the practice of this invention.
Figure 3:
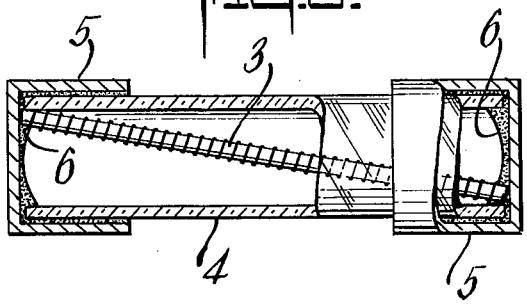
FIG. 3 is a side, partly sectional view of a time-delay fuse embodying the principles of this invention.
Figure 2:
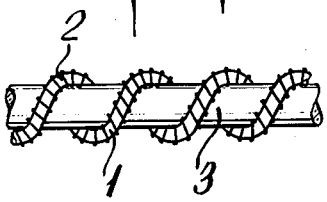
FIG. 2 is a side view illustrating the manner in which the wire strand shown in FIG. 1 is wound over a rod-like core member in accordance with this invention.

Referring now to FIG. 1, there is shown a wire strand made by winding a metallic fusible wire element 2 over a metallic mutually fusible wire core 1 as more fully described in Japanese Patent Application Ser. No. 1491 filed January 19, 1970, which disclosure is fully incorporated herein by reference. The wire strand is then spirally wound over a highly heat conductive, ceramic, elongated, generally cylindrical (rod-like) member 3 as shown in FIG. 2, and the ceramic rod-like member 3 is then diagonally positioned in a dielectric tubular member 4 such as, e.g., a glass or ceramic tube as illustrated in FIG. 3. The terminals of the wire strand are soldered at the ends of the rod-like core member 3 with a high melting solder element as shown at 6 in intimate contact with the sealing means 5 (e.g., ferrules or any other suitable sealing means.)

The two wire elements 1 and 2 used to make the wire strand shown in FIG. 2 can be made from a variety of metals which have good electrical conductivity and high melting points. The method of making the wire strand is more fully described in the aforesaid Japanese patent.

The wire strand is spirally wound over the elongated cylindrical core member 3 and is preferably wound at a pitch of about 5 to 10 per cm. Although the pitch may vary somewhat without adversely effecting the performance of the fuse.

The rod-like core member 3 is preferably made from a highly heat conductive material comprising essentially aluminum oxide and magnesium oxide, preferably a sintered blend of aluminum oxide and magnesium oxide spinel. The relative compositions of the two oxide may vary somewhat although we have found that the best material is one which comprises essentially of about 72 weight percent aluminum oxide and 28 weight percent magnesium oxide.

The rod-like member 3 has a generally uniform cylindrical or polygonal cross-sectional area in order to insure adequate and sufficient contact between the fusible wire element and the rod-like member 3 along its entire length. This permits effective cooling of the fusible wire element by utilizing the superior thermal conductivity of the ceramic core. Therefore, when excessive current flows through the wire strand, e.g., when the current flow is of the order of 200% of rated current capacity of A type standard fuse, the fuse wire is considerably cooled by the ceramic support (the rod-like member 3). Since the fusible wire will not melt until the temperature of the ceramic support reaches the melting point of the wire, it is possible to realize considerable time lag characteristics by using the time-delay fuses which are made in accordance with this invention. This is to be contrasted with the prior art type fuses wherein the cross-sectional area of the support material is star shaped or irregular, and which do not afford suitable contact between the fusible wire element and the support material, and hence show inferior time lag characteristics.

While we do not wish to be bound by any particular theory or machanism, the state of thermal equilibrium when the maximum amount of electrical current is passing through an ordinary type glass fuse can be described by the following equation:

$$Q = q_c + q_a$$

where $Q$ is the amount of heat, in calories, generated per unit length at the central region of the fusible wire element, $q_c$ is the amount of heat, in calories, conducted from each unit length of the fusible wire to the terminal ends of the fuse, and $q_a$ is the amount of heat, in calories, which diffuses from each unit length of the fusible wire to the surrounding atompshere (air).

When both $q_c$ and $q_a$ are decreased, Q is decreased correspondingly and, therefore, from the relationship between the rated current value and the diameter of the fusible wire, it becomes possible to decrease the rated current value, hence resulting in time lag characteristics in the fuse.

By using a relatively long fusible wire element, it is possible to decrease the amount of heat $q_c$ which flows from the center toward the terminals of the wire. Also, since two adjoining wires are used to make the wire strand as shown in FIG. 1, they are affected by heat generation in the same manner and hence it is possible to decrease the amount of heat $q_a$ which diffuses into the surrounding atmosphere.

In one specific embodiment of this invention, effective cooling of the fusible wire element and hence more improved time lag characteristics are realized by making the rod-like member 3 from a sintered blend of spinel ceramic material consisting of 71.8 weight percent alumina and 28.2 weight percent magnesia. This material has considerably higher thermal conductivity than quartz glass or alumina refractory as is shown in the following table.

| Support Material | Composition, Wt. % | Thermal Conductivity at 100° C, K cal/m.hr. ° C |
|---|---|---|
| Quartz glass | 100% $SiO_2$ | 0.8 |
| Alumina Refractory | 75% $Al_2O_3$ 25% Clay | 3.8 |
| Spinel $Al_2O_3$ : MgO | 71.8% $Al_2O_3$ 28.2% MgO | 12.9 |

Figure 4:
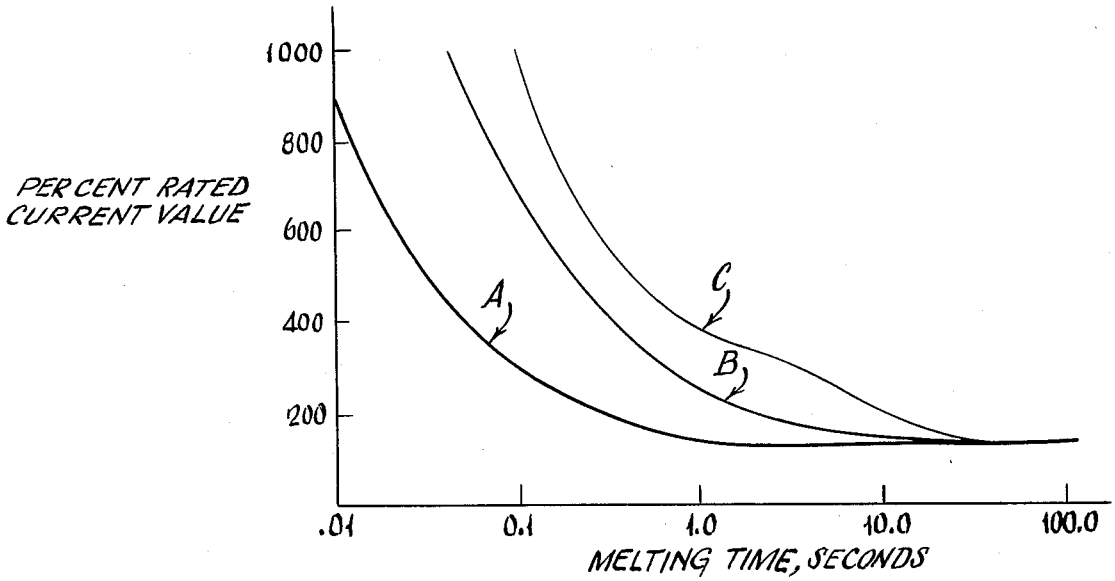
FIG. 4 compares the time-delay characteristics of a fuse made in accordance with a specific embodiment of this invention with two fuses made in accordance with the prior art.

FIG. 4 compares the time lag characteristics of a fuse made in accordance with this invention with two prior art fuses. In this figure the percent rated current value is plotted as a function of the time (in seconds) which takes to melt the fusible wire element. Curve A represents the relationship for a single line ordinary type A fuse with a rated current capacity of 5 Amperes, Curve B represents the relationship for a fuse in which the fusible wire element is made in accordance with the aforementioned Japanese patent application and which also has a rated current capacity of 5 Amperes. Curve C represents the relationship for a wire strand such as the wire shown in FIG. 2 (as in Curve B) wound at a pitch of 7.5/cm over a spinel ceramic rod-like support member made of 71.8% alumina and 28.2% magnesia. It was noted that rated current capacity of the latter fuse decreased from 5 to 3.5 Amperes while exhibiting time lag characteristics superior to the other two types of fuse.

Thus in accordance with this invention, time-delay fuses can be made which exhibit superior time lag characteristics while maintaining their mechanical integrity. For example, by diagonally positioning the rod-like member 3 in the fuse tube and soldering the fusible wire elements at the ends by high melting point solder in the manner hereinbefore described, the resulting fuse exhibits higher impact strength and greater resistance against vibration and therefore they can be shipped, stored and handled without breakage or deformation. Also, since adequate amounts of high melting solder is used to solder the fusible wire elements at the terminals, this type of fuse can be readily mass produced at low cost while retaining their mechanical rigidity and excellent time delay performance.

In addition, since the melting point of the ceramic core is rather high ($Al_2O_3$: MgO spinel has a melting point of 2135° C.), variety of fusible wires can be used without the limitation inherent in the types of fuses previously discussed which employ a glass fiber core or similar core materials. Furthermore, in these glass fiber fuses, the glass fiber core is placed in a glass tube and attached to the terminal ends of the tube while subjecting them to some tensile force in order to maintain them rigidly in position so that they do not become loose and dislodge under impact or mechanical vibration. In contrast, when the rod-like member 3 is diagonally positioned as aforesaid, there is no need to exert a tensile force during their installation.

The time-delay fuses of this invention can be made in various rated capacities ranging from about few milliamperes to about several amperes and as high as 30 amperes, and they can be conveniently mass produced in miniature sizes (about 3 cm. long) at moderate costs while retaining the requisite mechanical rigidity and time delay characteristics.

Although the invention has heretofore been described with certain degrees of particularity, neither the detailed description thereof nor the description of its specific embodiment is intended to limit the scope of this invention since obvious modifications can be made therein without necessarily departing from the scope or spirit of this invention. Such modifications will readily suggest themselves to those skilled in the art from the foregoing descriptions.

What is claimed is:

1. A time-delay fuse having improved time delay characteristics comprising an insulated tubular member having two ends, sealing means at said ends, an elongated generally cylindrical core member diagonally disposed in said tubular member in intimate contact with said sealing means, a wire strand spirally wound on said elongated core member and fixed at both ends thereof, said wire strand being defined by a pair of mutually fusible wire elements consisting of a first wire element wound over a second wire core and said elongated core member being selected from a material which has a high thermal conductivity.

2. A time-delay fuse as in claim 1 wherein said insulated tubular member is a glass or ceramic tubular member.

3. A time-delay fuse as in claim 1 wherein said elongated core member is made from a highly heat conductive ceramic material.

4. A time-delay fuse as in claim 2 wherein said elongated core member is made from a highly heat conductive ceramic material.

5. A time-delay fuse as in claim 1 wherein said elongated core member is a material comprising substantially of aluminum oxide and magnesium oxide.

6. A time-delay fuse as in claim 2 wherein said elongated core member is a material comprising substantially of aluminum oxide and magnesium oxide.

7. A time-delay fuse as in claim 5 wherein said elongated core material comprises essentially of about 72 weight percent aluminum oxide and about 28 weight percent magnesium oxide.

8. A time-delay fuse as in claim 6 wherein said elongated core material comprises essentially of about 72 weight percent aluminum oxide and about 28 weight percent magnesium oxide.

* * * * *